US008244150B2

(12) United States Patent
Kumada et al.

(10) Patent No.: US 8,244,150 B2
(45) Date of Patent: Aug. 14, 2012

(54) FIXING APPARATUS

(75) Inventors: Hiromitsu Kumada, Susono (JP); Teruhiko Namiki, Mishima (JP); Atsunobu Mori, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 31 days.

(21) Appl. No.: 12/792,017

(22) Filed: Jun. 2, 2010

(65) Prior Publication Data

US 2010/0322657 A1 Dec. 23, 2010

(30) Foreign Application Priority Data

Jun. 19, 2009 (JP) ..... 2009-147001

(51) Int. Cl.
*G03G 15/20* (2006.01)

(52) U.S. Cl. ..... 399/69; 399/88; 219/216; 219/494

(58) Field of Classification Search ..... 399/38, 399/67, 69, 70, 75, 88, 320, 328; 219/216, 219/482, 485, 486, 490, 494
See application file for complete search history.

(56) References Cited

U.S. PATENT DOCUMENTS 5,907,743 A * 5/1999 Takahashi ..... 399/69
6,778,789 B2 * 8/2004 Cho et al. ..... 399/69
7,327,967 B2 2/2008 Mori et al.
7,630,662 B2 12/2009 Namiki et al.
2008/0118264 A1 5/2008 Mori et al.
2010/0215391 A1 8/2010 Namiki et al.

FOREIGN PATENT DOCUMENTS

JP 2006-073431 3/2006

* cited by examiner

*Primary Examiner* — Walter L Lindsay, Jr.
*Assistant Examiner* — Benjamin Schmitt
(74) *Attorney, Agent, or Firm* — Fitzpatrick, Cella, Harper & Scinto

(57) ABSTRACT

A fixing apparatus allows harmonic noise and flicker noise caused by alternating current to be reduced. To accomplish this, the fixing apparatus has a power supply unit that supplies AC power from a commercial power supply to a heater, a temperature detection element that detects the temperature of the heater, a setting unit that sets a duty ratio for providing power to the heater such that the temperature detected by the temperature detection element maintains a target temperature, and a control unit that controls the power supply unit such that an average power duty ratio of a single cycle equals the power duty ratio based on the detected temperature, where a single cycle is three or more full waves of the commercial power supply, there being three or more power duty ratios per one half wave of the commercial power supply in a single cycle.

2 Claims, 12 Drawing Sheets

FIG. 6

| P% | DISTRIBUTION PATTERN | P% | DISTRIBUTION PATTERN | P% | DISTRIBUTION PATTERN |
|---|---|---|---|---|---|
| 100% | N/A | 66% | 4 | 32% | 1 |
| 99% | N/A | 65% | 4 | 31% | 1 |
| 98% | N/A | 64% | 4 | 30% | 1 |
| 97% | N/A | 63% | 4 | 29% | 1 |
| 96% | N/A | 62% | 3 | 28% | 1 |
| 95% | 1 | 61% | 3 | 27% | 1 |
| 94% | 1 | 60% | 3 | 26% | 1 |
| 93% | 1 | 59% | 3 | 25% | 1 |
| 92% | 1 | 58% | 3 | 24% | 1 |
| 91% | 1 | 57% | 3 | 23% | 1 |
| 90% | 2 | 56% | 3 | 22% | 1 |
| 89% | 2 | 55% | 3 | 21% | 1 |
| 88% | 2 | 54% | 3 | 20% | 2 |
| 87% | 2 | 53% | 3 | 19% | 2 |
| 86% | 2 | 52% | 3 | 18% | 2 |
| 85% | 2 | 51% | 3 | 17% | 2 |
| 84% | 2 | 50% | 3 | 16% | 2 |
| 83% | 2 | 49% | 3 | 15% | 2 |
| 82% | 2 | 48% | 3 | 14% | 2 |
| 81% | 2 | 47% | 3 | 13% | 2 |
| 80% | 2 | 46% | 3 | 12% | 2 |
| 79% | 1 | 45% | 3 | 11% | 2 |
| 78% | 1 | 44% | 3 | 10% | 2 |
| 77% | 1 | 43% | 3 | 9% | 1 |
| 76% | 1 | 42% | 3 | 8% | 1 |
| 75% | 1 | 41% | 3 | 7% | 1 |
| 74% | 1 | 40% | 3 | 6% | 1 |
| 73% | 1 | 39% | 3 | 5% | 1 |
| 72% | 1 | 38% | 3 | 4% | N/A |
| 71% | 1 | 37% | 4 | 3% | N/A |
| 70% | 1 | 36% | 4 | 2% | N/A |
| 69% | 1 | 35% | 4 | 1% | N/A |
| 68% | 1 | 34% | 4 | 0% | N/A |
| 67% | 4 | 33% | 4 | – | – |

FIG. 7

| DISTRIBUTION PATTERN | 1st FULL WAVE | | 2nd FULL WAVE | | 3rd FULL WAVE | | 4th FULL WAVE | |
|---|---|---|---|---|---|---|---|---|
| | 1st HALF WAVE | 2nd HALF WAVE | 3rd HALF WAVE | 4th HALF WAVE | 5th HALF WAVE | 6th HALF WAVE | 7th HALF WAVE | 8th HALF WAVE |
| PATTERN 1 | +2% | +2% | -2% | -2% | +3% | +3% | -3% | -3% |
| PATTERN 2 | +2% | +2% | -2% | -2% | +5% | +5% | -5% | -5% |
| PATTERN 3 | +30% | +30% | -30% | -30% | +33% | +33% | -33% | -33% |
| PATTERN 4 | +35% | +35% | -35% | -35% | +35% | +35% | -35% | -35% |

FIG. 9

| DISTRIBUTION PATTERN | 1st FULL WAVE | | 2nd FULL WAVE | | 3rd FULL WAVE | | 4th FULL WAVE | | 5th FULL WAVE | | 6th FULL WAVE | | 7th FULL WAVE | | 8th FULL WAVE | |
|---|---|---|---|---|---|---|---|---|---|---|---|---|---|---|---|---|
| | 1st HALF WAVE | 2nd HALF WAVE | 3rd HALF WAVE | 4th HALF WAVE | 5th HALF WAVE | 6th HALF WAVE | 7th HALF WAVE | 8th HALF WAVE | 9th HALF WAVE | 10th HALF WAVE | 11th HALF WAVE | 12th HALF WAVE | 13th HALF WAVE | 14th HALF WAVE | 15th HALF WAVE | 16th HALF WAVE |
| PATTERN 2-1 | +2% | +2% | -2% | -2% | +3% | +3% | -3% | -3% | +4% | +4% | -4% | -4% | +5% | +5% | -5% | -5% |
| PATTERN 2-2 | +2% | +2% | -2% | -2% | +5% | +5% | -5% | -5% | +7% | +7% | -7% | -7% | +10% | +10% | -10% | -10% |
| PATTERN 2-3 | +30% | +30% | -30% | -30% | +33% | +33% | -33% | -33% | +36% | +36% | -36% | -36% | +40% | +40% | -40% | -40% |
| PATTERN 2-3' | +33% | -33% | +30% | -30% | -30% | +30% | -33% | +33% | +40% | -40% | +36% | -36% | -36% | +36% | -40% | +40% |
| PATTERN 2-4 | +35% | +35% | -40% | -40% | +35% | +35% | -30% | -30% | +35% | +35% | -45% | -45% | +35% | +35% | -25% | -25% |
| PATTERN 2-4' | +35% | -40% | +35% | -30% | -30% | +35% | -40% | +35% | +35% | -45% | +35% | -25% | -25% | +35% | -45% | +35% |

FIXING APPARATUS

BACKGROUND OF THE INVENTION

1. Field of the Invention

The present invention relates to a fixing apparatus.

2. Description of the Related Art

Heretofore, heating apparatuses that drive a heater with phase control using an AC power supply as the drive source are known. With conventional phase control, there is a problem in that harmonic noise levels increase when power varies widely. For example, if power is supplied at a duty ratio of 50%, the power supply is switched on/off at timings at which the sine wave peaks at phase angles of 90 and 270 degrees, as is shown in 11*a* in FIG. 11. In this case, noise is produced because of supplied power suddenly changing to zero.

In response, Japanese Patent Laid-Open No. 2006-73431 discloses a technique according to which on/off control of the heater is not performed at timings near the peaks of the sine wave indicating input power, in order to reduce sudden changes in power variation when performing phase control.

However, the following problem exists with the technique of Japanese Patent Laid-Open No. 2006-73431. When printing is performed continuously for an extended period of time, power input to the heater stabilizes to a substantially constant value due to the fixing apparatus warming up sufficiently. At this time, the harmonic levels of a specific order increase despite control being performed so as to avoid using heater current application start timings at which harmonic levels will be adversely affected, due to the same current application start timings being repeatedly used.

SUMMARY OF THE INVENTION

The present invention has been made in consideration of the problems with the above conventional technology, and provides a fixing apparatus that allows harmonic noise and flicker noise caused by alternating current to be reduced.

One aspect of the present invention provides a fixing apparatus comprising: a power supply unit that supplies AC power from a commercial power supply to a heater; a temperature detection element that detects a temperature of the heater; a setting unit that sets a power duty ratio for providing power to the heater such that the temperature detected by the temperature detection element maintains a target temperature; and a control unit that controls the power supply unit such that an average power duty ratio of a single cycle equals the power duty ratio based on the detected temperature, where a single cycle is three or more full waves of the commercial power supply, wherein there are three or more power duty ratios per one half wave of the commercial power supply in a single cycle.

The present invention enables the provision of a fixing apparatus that allows for a reduction in harmonic noise and flicker noise caused by alternating current, for example.

Further features of the present invention will become apparent from the following description of exemplary embodiments (with reference to the attached drawings).

BRIEF DESCRIPTION OF THE DRAWINGS

FIG. 6 shows a table for selecting a distribution pattern corresponding to a required power duty ratio P according to the First Embodiment of the present invention.

FIG. 7 shows distribution patterns according to the First Embodiment of the present invention.

FIG. 9 shows distribution patterns according to a Second Embodiment of the present invention.

DESCRIPTION OF THE EMBODIMENTS

Hereinafter, preferred embodiments of the present invention will be illustratively described in detail with reference to the drawings. The constituent elements described in the following embodiments are merely by way of example, and it is not intended to limit the technical scope of the present invention to these constituent elements. Not all combinations of features described in the embodiments are essential as a means of resolving of the present invention.

First Embodiment

Concepts

Figure 11:
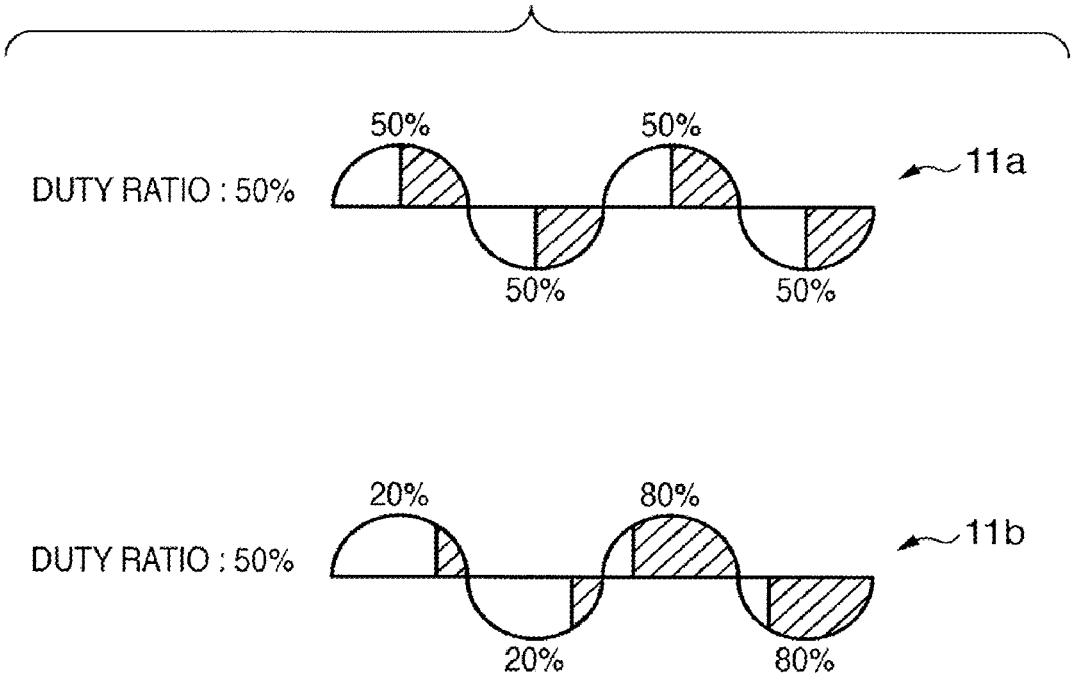
FIG. 11 PRIOR ART
FIG. 11 illustrates distribution control.

In a First Embodiment of the present invention, control is performed such that on/off control of a heater is not performed at timings near the peaks of a sine wave indicating input power, so that power does not vary widely, when performing phase control. In other words, the supply of power is switched on and off while avoiding timings near the peaks. Specifically, in the case of power being supplied at a duty ratio of 50%, for example, an average duty ratio of 50% is realized by performing control for one wavelength at a duty ratio of 20% and subsequently performing control for one wavelength at a duty ratio of 80% as shown in 11*b* in FIG. 11.

With control at a duty ratio of 20%, power is, for example, turned on at a phase angle of 144 degrees, off at 180 degrees, on at 324 degrees, and off at 360 degrees. With control at a duty ratio of 80%, power is, for example, turned on at a phase angle of 36 degrees, off at 180 degrees, on at 216 degrees, and off at 360 degrees. A wide variation in power can thereby be avoided, enabling noise to be reduced. A combination of duty ratios of 20% and 80% for realizing a duty ratio of 50% are represented using a (−30, +30) pattern, which will be referred to in the present specification as a "distribution pattern". Note that the combination included in a distribution pattern is not limited to a combination of the differences from a target value of duty ratios relating to two full waves as described here, and may be a combination of three or more full waves. For example, in the First Embodiment, a combination of the differences from the target value of duty ratios relating to four full waves is used as a single distribution pattern, and four distribution patterns are defined.

Specifically, the numerical sequence "+2, −2, +3, −3" is defined as a distribution pattern 1, and the numerical sequence "+2, −2, +5, −5" is defined as a distribution pattern 2. Also, a numerical sequence "+30, −30, +33, −33" is defined as a distribution pattern 3, and a numerical sequence "+35, −35, +35, −35" is defined as a distribution pattern 4. Power supply for four full waves will be performed at duty ratios of 80%, 20%, 83% and 17% when distribution pattern 3 is used with a duty ratio of 50% as the target. In this case, the variation in power can be suppressed and harmonic noise reduced, without switching the supply of power on/off at timings in proximity to the peaks of the sine wave that occur at phase angles of 90 and 270 degrees.

Also, an increase in flicker due to a power of similar shape being continuously applied to the heater can be readily prevented without increasing the load on the CPU by defining a plurality of distribution patterns.

Configuration

Figure 1:
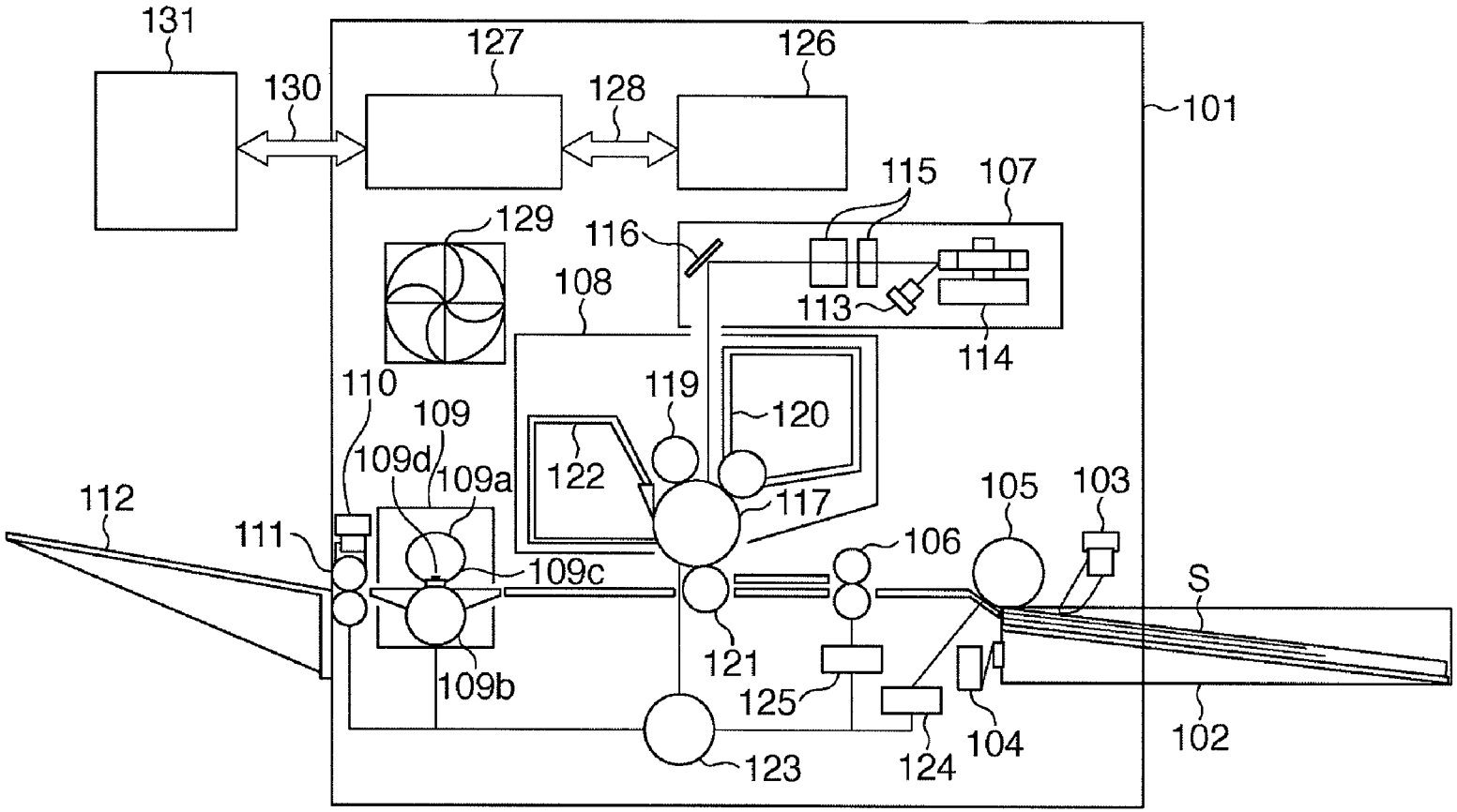
FIG. 1 is a schematic configuration diagram of a laser printer that uses an electrophotographic process according to a First Embodiment of the present invention.

FIG. 1 is a schematic configuration diagram of a laser printer using an electrophotographic process that serves as a First Embodiment of an image forming apparatus according to the present invention. The laser printer 101 is capable of mounting a cassette 102 for housing recording sheets S that serve as recording media, and forms images on recording sheets S provided from this cassette 102. Reference numeral 103 denotes a cassette sensor that detects the presence of recording sheets S in the cassette 102. Reference numeral 104 denotes a cassette size sensor that detects the size of recording sheets S housed in the cassette 102, and is here constituted by a plurality of micro switches, for example. Reference numeral 105 denotes a paper feed roller that picks up and conveys recording sheets S from the cassette 102. A pair of registration rollers 106 for synchronously conveying the recording sheets S is provided downstream of this paper feed roller 105 on the conveyance path. An image forming portion 108 that forms a toner image on a recording sheet S using toner as a developing material based on laser light from a laser scanner portion 107 is provided downstream of this pair of registration rollers 106. Further, a fixer 109 for using heat to fix the toner image formed on the recording sheet S is provided downstream of this image forming portion 108. A paper discharge sensor 110 that detects the conveyance state of a paper discharge portion, paper discharge rollers 111 that discharge recording sheets S, and a loading tray 112 for loading and housing recording sheets S on which images have been formed and fixed are provided downstream of this fixer 109. Note that here a reference for conveying these recording sheets S is set so as to be approximately in the center with respect to the length of a direction orthogonal to the conveyance direction of recording sheets S, that is, with respect to the width of recording sheets S.

Also, the laser scanner portion 107 has a laser unit 113 that emits laser light modulated based on image signals (image signals VDO) sent by an external apparatus 131. The laser light from this laser unit 113 scans over a photosensitive drum 117 after being reflected by a polygon mirror rotationally driven by a motor 114, and by an imaging lens 115, a folding mirror 116 and the like.

The image forming portion 108 has the photosensitive drum 117, a primary charging roller 119, a developer 120, a transfer charging roller 121, a cleaner 122 and the like. The fixer 109 has a fixing film 109*a*, an elastic pressure roller 109*b*, a ceramic surface heater 109*c* provided inside the fixing film 109*a*, and a temperature detection element 109*d* (thermistor) that detects the surface temperature of the ceramic surface heater 109*c*. That is, toner is fixed on a recording sheet using the heat of the ceramic surface heater 109*c*.

A main motor 123 provides torque to the paper feed roller 105 via a paper feed roller clutch 124. The main motor 123 also provides torque to the pair of registration rollers 106 via a registration roller clutch 125. Further, the main motor 123 provides driving power to the various units of the image forming portion 108 including the photosensitive drum 117, as well as to the fixer 109, and the paper discharge rollers 111. Reference numeral 126 denotes an engine controller that controls the electrophotographic process by the laser scanner portion 107, the image forming portion 108 and the fixer 109, and the conveyance of recording sheets S in the laser printer 101. Reference numeral 127 denotes a video controller that is connected to an external apparatus 131 such as a personal computer via a general-purpose interface (Centronics interface, RS232C interface, etc.) 130. The video controller 127 converts image information received via this general-purpose interface 130 to bit data, and sends this bit data to the engine controller 126 as a VDO signal.

Figure 2:
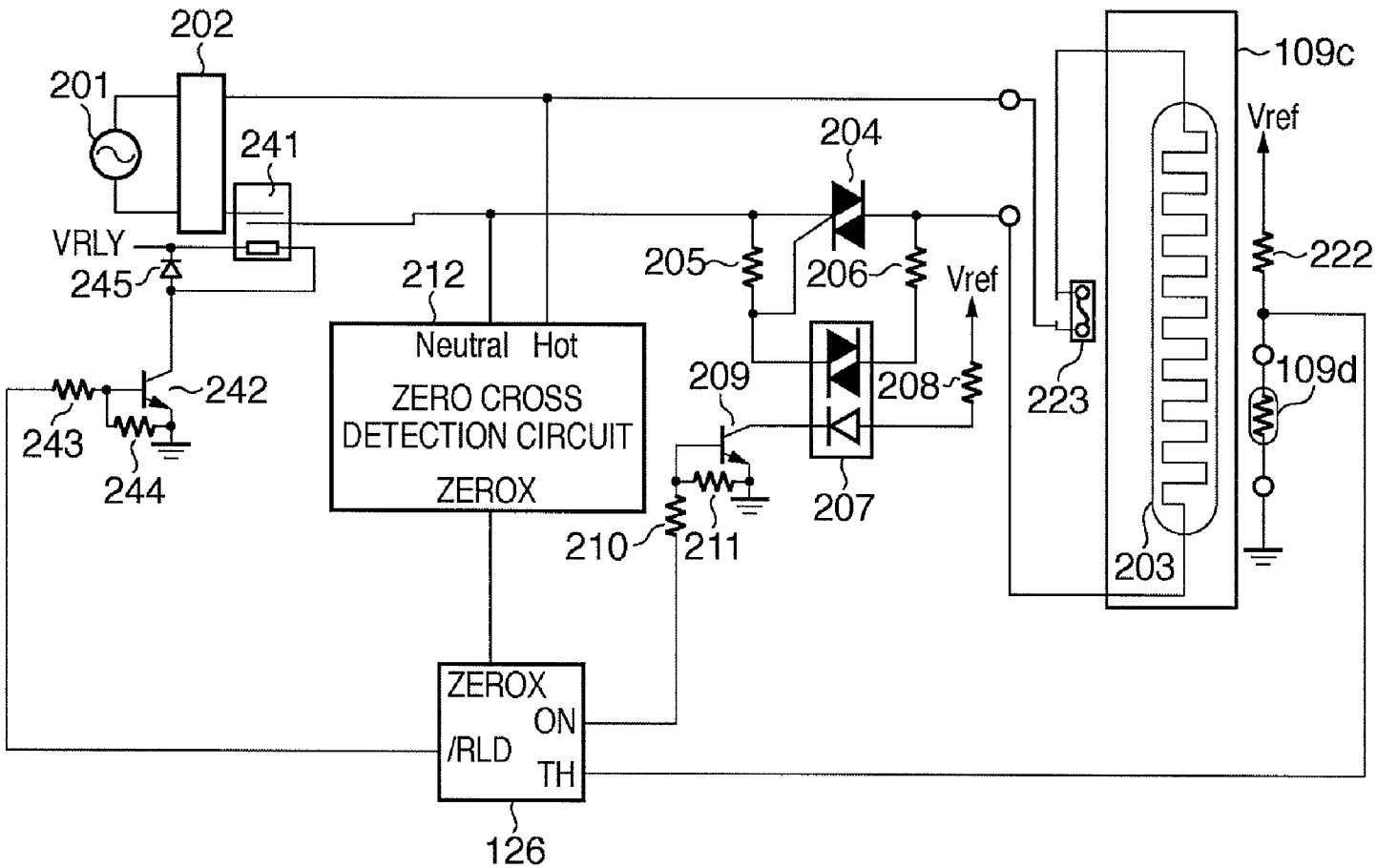
FIG. 2 is a block diagram showing a configuration of a heater control circuit that controls the application of drive current to a ceramic surface heater in the First Embodiment of the present invention.

FIG. 2 is a circuit diagram showing a configuration of a heater control circuit that controls application of drive current to the ceramic surface heater 109*c* in the present embodiment.

Reference numeral 201 denotes a commercial power supply (commercial AC power supply) to which the laser printer 101 is connected. The laser printer 101 supplies the AC power from the commercial AC power supply 201 to a heating element 203 of the ceramic surface heater 109*c* via an AC filter 202 and a relay 241. The heating element 203 constituting the ceramic surface heater 109*c* is thereby heated. The supply of power to this heating element 203 is controlled by applying and interrupting current to a triac 204. Resistors 205 and 206 are bias resistors of this triac 204, and a phototriac coupler 207 is a device for securing creepage distance between primary and secondary. The triac 204 is turned on by applying current to a light-emitting diode of this phototriac coupler 207. A resistor 208 is for regulating current flowing to the phototriac coupler 207, and current to the phototriac coupler 207 is turned on/off by a transistor 209. This transistor 209 operates in accordance with a signal (ON) provided by the engine controller 126 via a resistor 210. A resistor 211 is a bias resistor between the base and emitter of the transistor 209.

The output from the commercial AC power supply 201 is input to a zero cross detection circuit 212 via the AC filter 202. The zero cross detection circuit 212 detects that the voltage has dropped below a zero cross point through which the commercial power supply voltage alternates between positive and negative values, or a given threshold voltage that includes this zero cross point, and notifies the detection result to the engine controller 126 as a pulse signal. Hereinafter, this signal sent to the engine controller 126 will be called a ZEROX signal. The engine controller 126 detects the pulse edge of this ZEROX signal, and performs on/off control of the triac 204 by phase control or wave number control.

The temperature detection element 109*d* is a thermistor temperature-sensing element that detects the temperature of the ceramic surface heater 109*c* on which the heating element 203 is formed. This temperature detection element 109*d* is disposed on the ceramic surface heater 109*c* via an insulator with dielectric strength, so that an insulation distance can be secured with respect to the heating element 203. The temperature detected by this temperature detection element 109*d* is detected as partial voltages of a resistor 222 and the temperature detection element 109*d*, and is input to the engine controller 126 as a TH signal. The TH signal thus input is A/D converted by the engine controller 126, and managed with a digital value.

The temperature of the ceramic surface heater 109*c* is monitored as the TH signal by the engine controller 126. The engine controller 126 calculates the power duty ratio of AC power to be supplied to the heating element 203 constituting the ceramic surface heater 109*c* by comparing the temperature of the ceramic surface heater 109*c* and a set temperature of the ceramic surface heater 109*c* set by the engine controller 126. Further, the engine controller 126 converts the power duty ratio of AC power to be supplied to corresponding phase angles (phase control) or wave numbers (wave number control), and sends an ON signal to the transistor 209 depending on the control conditions. The temperature of the ceramic surface heater 109*c* is thus controlled. For example, in the case of phase control, a control table such as table 1 below is held in the engine controller 126. The engine controller 126 executes the above control based on this control table.

TABLE 1

| POWER DUTY RATIO D (%) | PHASE ANGLE (degree) |
|---|---|
| 100 | 0 |
| 97.5 | 28.56 |
| . | . |
| . | . |
| . | . |
| 75 | 66.17 |
| . | . |
| . | . |
| . | . |
| 50 | 90 |
| . | . |
| . | . |
| . | . |
| 25 | 113.83 |
| . | . |
| . | . |
| . | . |
| 2.5 | 151.44 |
| 0 | 180 |

Further, an over-temperature protection portion 223 is disposed on the ceramic surface heater 109*c* as a means of protecting against an excessive rise in temperature in the case where the heating element 203 goes into a thermal runaway state due, for instance, to the failure of circuitry that supplies power to the heating element 203 and controls the heating element 203. This over-temperature protection portion 223 is, for example, a temperature fuse or a thermoswitch. When the over-temperature protection portion 223 reaches a prescribed temperature after the heating element 203 has gone into a thermal runaway state, the over-temperature protection portion 223 enters a released state, and the application of current to the heating element 203 is interrupted.

An abnormal temperature value for detecting abnormally high temperatures is set by the engine controller 126 separately from the set value for temperature control, in order to control the temperature of the ceramic surface heater 109*c* monitored as the TH signal. If the temperature of the ceramic surface heater 109*c* indicated by the TH signal reaches this abnormal temperature value, the engine controller 126 sets an RLD signal to low. A transistor 242 thereby enters an off state, and the relay 241 is released. The application of current to the heating element 203 is thus interrupted. Normally, when performing temperature control, the engine controller 126 turns on the transistor 242 by constantly outputting the RLD signal at a high level, turning the relay 241 on (conduction state). A resistor 243 is a current regulation resistor, and a resistor 244 is a bias resistor between the base and emitter of the transistor 242. A diode 245 is a back electromotive force absorption element for when the relay 241 is off.

This ceramic surface heater 109*c* includes an insulating substrate 331 made of ceramics such as SiC, AN and $Al_2O_3$, the heating element 203 formed, for instance, by printing a paste on this insulating substrate 331, and a protective layer 334 made of glass or the like that protects the heating element. The temperature detection element 109*d* for detecting the temperature of the ceramic surface heater 109*c* and the over-temperature protection portion 223 are disposed on this protective layer 334. These components are disposed in positions that are bilaterally symmetrical with respect to a reference for conveying recording sheets, or in other words, the middle in the lengthwise direction of a heating portion 203*a*, and that are inside of the minimum acceptable recording sheet width.

Figure 3:
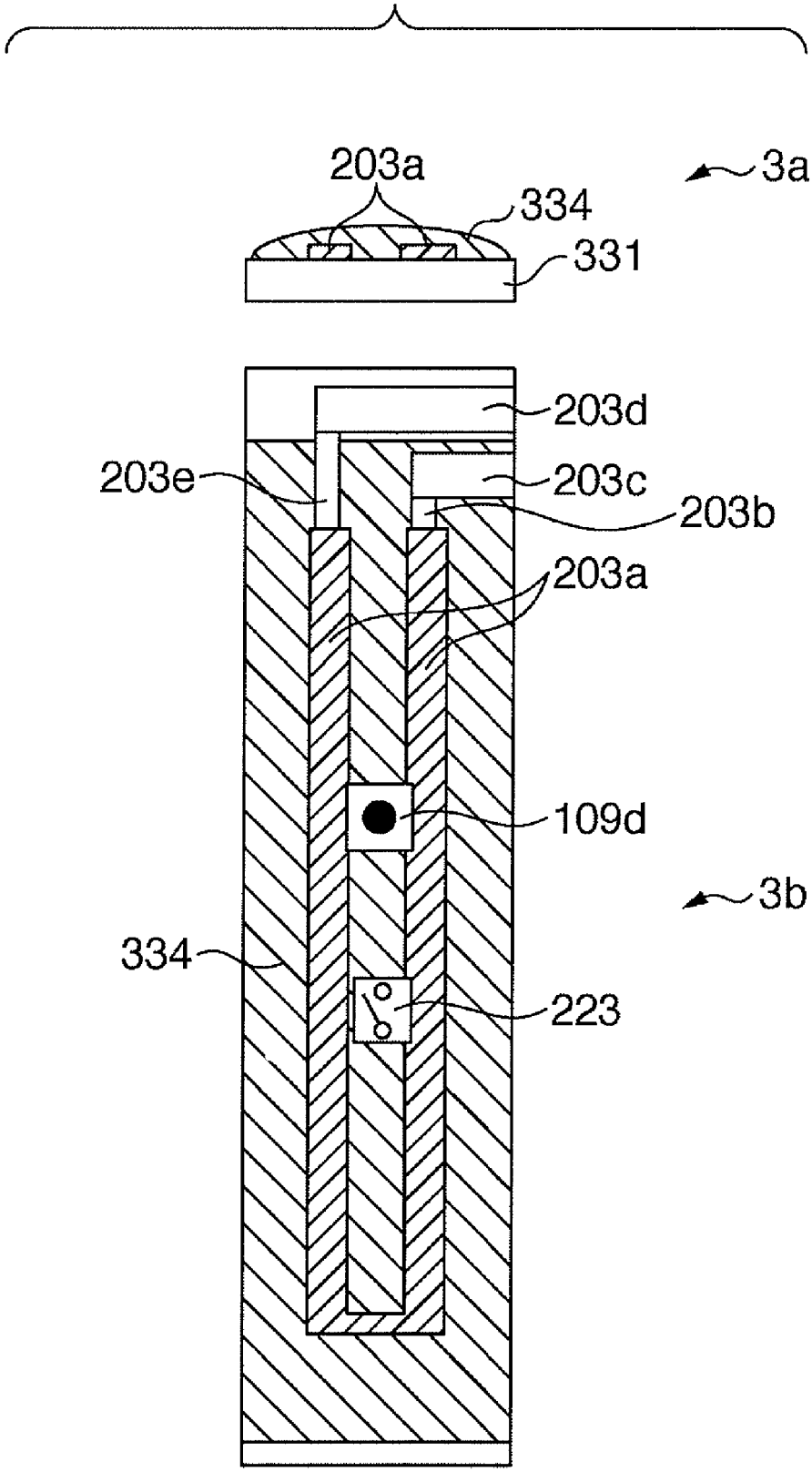
FIG. 3 illustrates a schematic view s of a ceramic surface heater according to the First Embodiment of the present invention.

FIG. 3 illustrates schematics of the ceramic surface heater 109*c* according to the present embodiment. Reference characters 3*a* in FIG. 3 denote a cross-sectional view of the ceramic surface heater 109*c*, and reference characters 3*b* in FIG. 3 denote a plan view of the ceramic surface heater 109*c* (i.e., shows the surface on which the heating element 203 is formed).

The heating element 203 has the heating portion 203*a* that produces heat when supplied with power, electrode portions 203*c* and 203*d* to which power is supplied via a connector, and electrically conductive portions 203*b* and 203*e* connecting these electrode portions 203*c* and 203*d* with the heating portion 203*a*. A glass layer may also be formed on the surface facing the insulating substrate 331 on which the heating element 203 is printed, in order to improve slidability.

The electrode portion 203*c* is connected from a hot terminal of the commercial AC power supply 201 via the over-temperature protection portion 223. The electrode portion 203*d* is connected to the triac 204 that controls the heating element 203, and to a neutral terminal of the commercial AC power supply 201. The ceramic surface heater 109*c* is supported by a film guide 62, as shown in FIG. 4.

Figure 4:
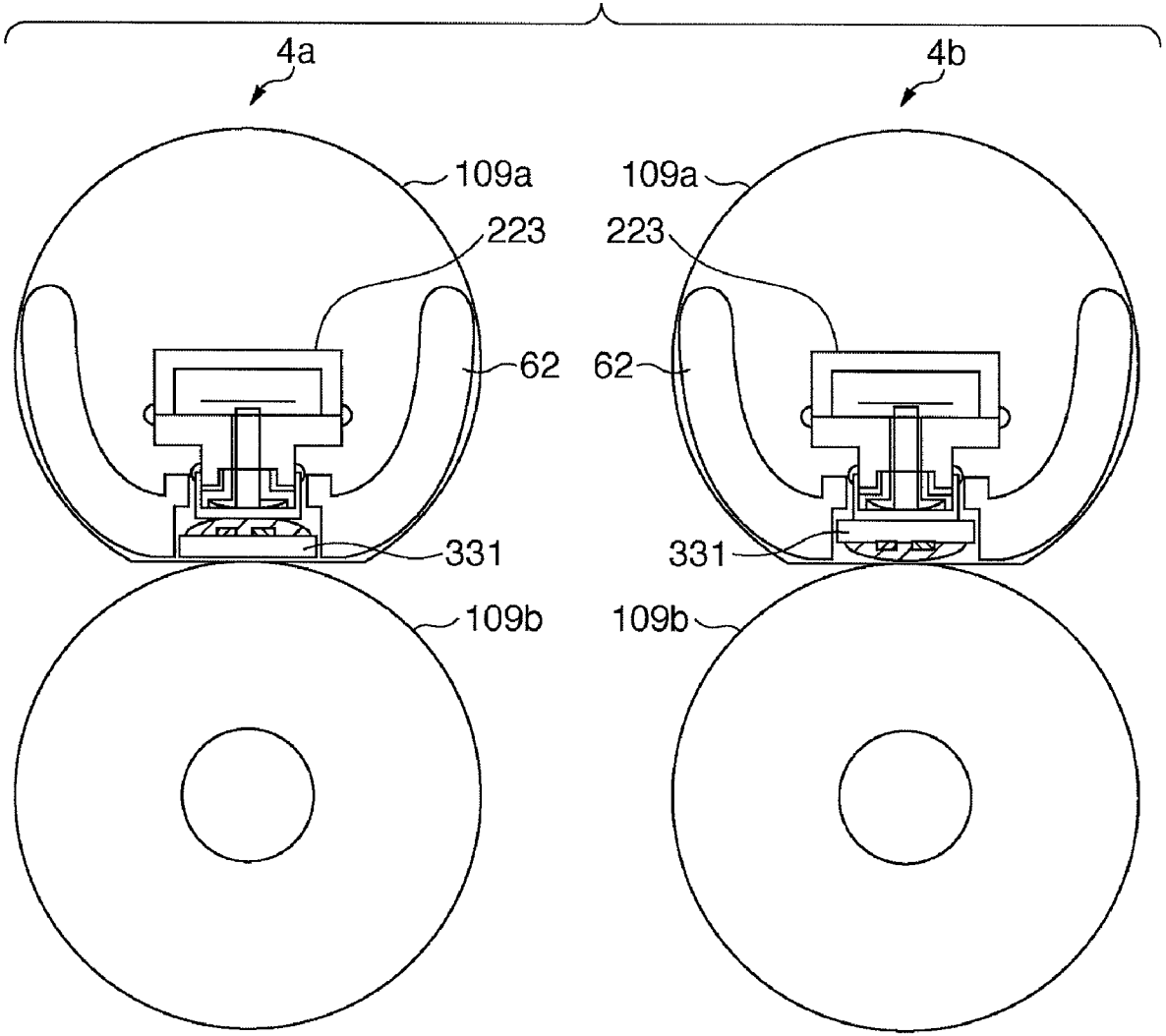
FIG. 4 shows schematic configurations of a fixer according to the First Embodiment of the present invention.

FIG. 4 shows schematic configurations of the fixer 109 according to the present embodiment. Reference characters 4*a* in FIG. 4 denote an illustration of the case where the heating element 203 is positioned on the opposite side of the insulating substrate 331 to a nip portion between the fixing film 109*a* and the elastic pressure roller 109*b*. Reference characters 4*b* in FIG. 4 denote an illustration of the case where the heating element 203 is positioned on the nip portion side of the insulating substrate 331.

The fixing film 109*a* is a cylindrical heat-resistant fixing film, and is fitted onto the film guide 62 supporting the ceramic surface heater 109*c* on the underside thereof. The ceramic surface heater 109*c* on the underside of this film guide 62 and the elastic pressure roller 109*b* serving as a pressure member are brought into contact across the fixing film 109*a* with a prescribed pressure against the elasticity of the elastic pressure roller 109*b*. A fixing nip portion of prescribed width serving as a heating portion is thus formed. The over-temperature protection portion 223 abuts on the surface of the insulating substrate 331 or the surface of the protective layer 334 of the ceramic surface heater 109*c*.

The position of this over-temperature protection portion 223 is corrected by the film guide 62, and a heat sensitive surface of the over-temperature protection portion 223 abuts on the surface of the ceramic surface heater 109*c*. Although not shown, the temperature detection element 109*d* also similarly abuts on the surface of this ceramic surface heater 109*c*. Here, with the ceramic surface heater 109*c*, the heating element 203 may be on the opposite side to the nip portion as shown in 4*a* in FIG. 4, or the heating element 203 may be on the nip portion side as shown in 4*b* in FIG. 4. Grease having a slidability property may also be applied to the interface between the fixing film 109*a* and the ceramic surface heater 109*c* in order to enhance the slidablity of the fixing film 109*a*.

Temperature Control

Figure 5A:
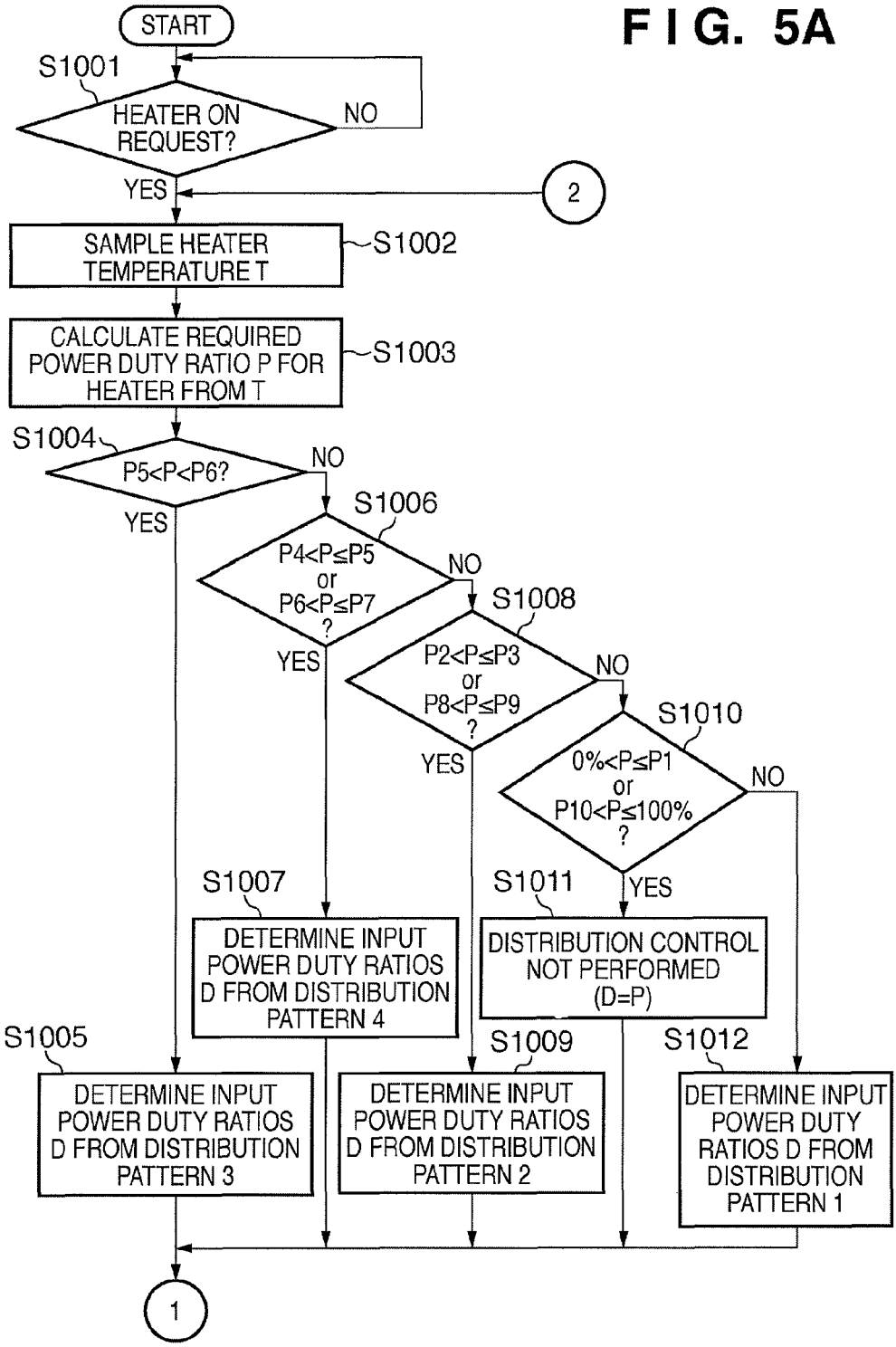
FIGS. 5A and 5B are flowcharts showing an example of a control sequence according to the First Embodiment of the present invention.
Figure 5B:
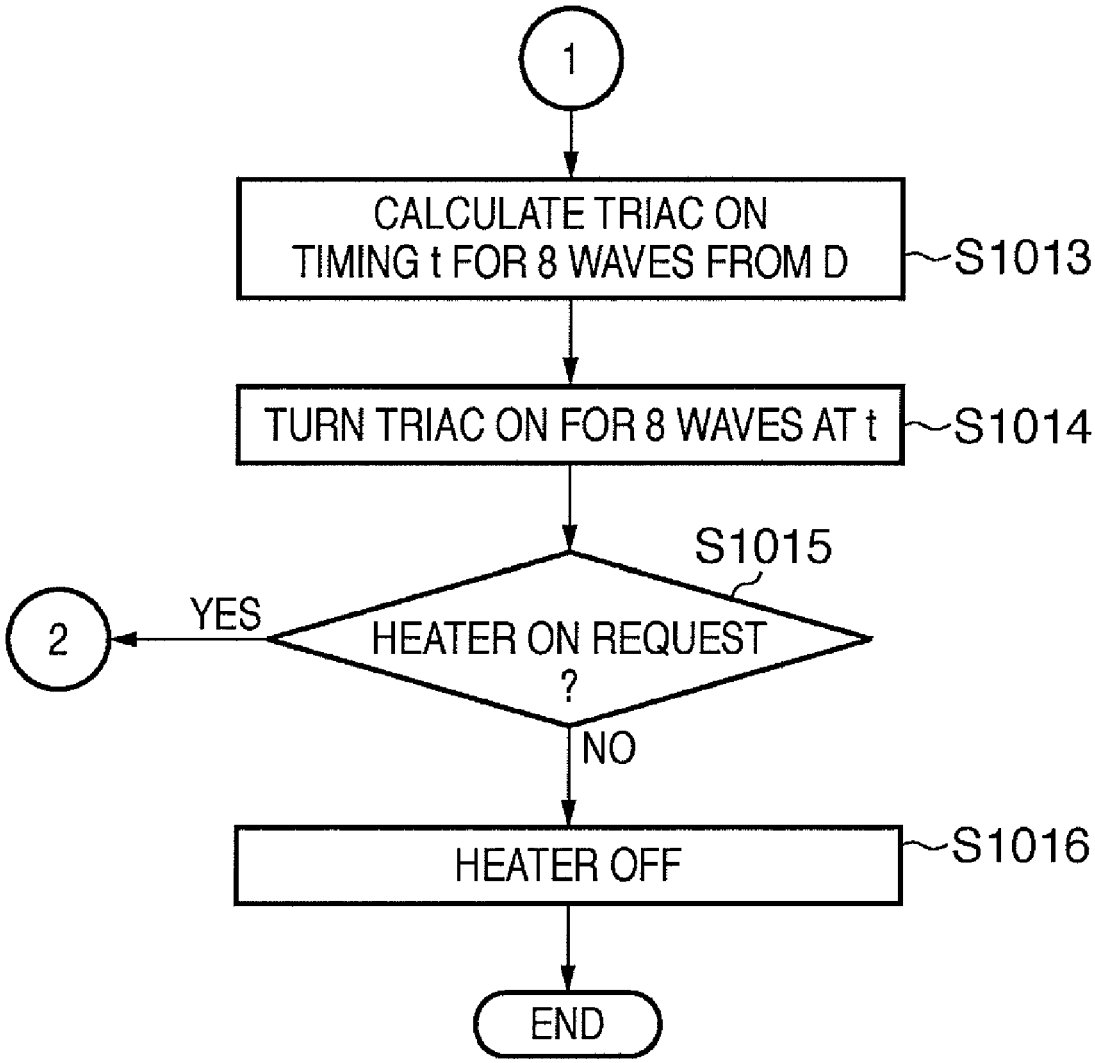

Next, temperature control by the engine controller 126 will be described based on FIGS. 5A and 5B. In the engine controller 126, when a print start request occurs (S1001), the temperature detection element 109*d* detects a temperature T of the ceramic surface heater 109*c* (S1002). The engine controller 126 calculates a power duty ratio P (first power duty ratio P) of AC power to be input to the ceramic surface heater 109*c*, based on the detected temperature T (S1003).

In other words, the engine controller 126 functions as a first determination portion that determines the first power duty ratio P for keeping the temperature of the ceramic surface heater 109*c* at a prescribed temperature. That is, the engine controller 126 sets the first power duty ratio P such that temperature detected by the temperature detection element 109*d* maintains a prescribed target temperature.

The calculation of the power duty ratio P is performed using PI (Proportional-Integral control) or PID control (Proportional-Integral-Differential control). The fixing apparatus whose heat source is the ceramic surface heater 109*c* calculates the duty ratio P (operation amount) of power to be supplied to the ceramic surface heater 109*c*, based on a PI or PID control equation, from the temperature difference between the temperature detected by the temperature detection element 109*d* and a preset target temperature. Corresponding phase angles or wave numbers are determined from this calculated power duty ratio, and on/off control of a switching element is performed with the determined phase angles or wave numbers to control the temperature of the fixing apparatus.

In the case of PI control, a calculated power duty ratio D is represented by the following equation:

$$D=Dp+Di(t)=Ap\times(Tt-Tn)+Di(t-\Delta t)+\Delta Di(t,Tt-Tn) \quad (1)$$

where Dp is a power duty ratio (operation amount) corresponding to proportional control, Di(t) is a power duty ratio (operation amount) corresponding to integral control at time t, Tn is the temperature detected by the temperature detection element, Tt is the target temperature, and Δt is the control interval. Note that Ap is the proportional control coefficient, and ΔDi(t,Tt−Tn) is the increment in the power duty ratio Di(t) corresponding to the integral control at time t. The temperature of the fixing apparatus is controlled by performing on/off control of the switching element using the power duty ratio D thus calculated from the deviation of the detected temperature from the target temperature. The distribution pattern is determined depending on the value of the required power duty ratio P calculated by PI or PID control, and the power duty ratios D (second power duty ratios) of power that will actually be input to the ceramic surface heater 109*c* are determined. In other words, the engine controller 126 functions as a second determination portion that determines a second power duty ratio D for each of a predetermined number of full waves, such that average supplied power (average power duty ratio) for the predetermined number of full waves (here, four) equals the first power duty ratio P. For example, the engine controller 126 controls power supply, such that the average power duty ratio of a single cycle equals the first power duty ratio P, where three or more full waves of AC power supplied from a commercial power supply are set as a single cycle. Further, the engine controller 126 also functions as a control portion that controls the phase of supplied AC power, according to the second power duty ratios D.

FIG. 6 shows the correspondence relation between required power duty ratios (first power duty ratios) P and distribution patterns, and FIG. 7 shows distribution patterns. Here, a distribution pattern is a numerical sequence for adjustment obtained by arranging a prescribed number (here, four) of numerical values to be added to the first power duty ratio P. A plurality of these distribution patterns is stored (here, four patterns) according to the first power duty ratio P, which takes an integer value from 0 to 100. Power input to the heater stabilizes to a substantially constant value as a result of the fixing apparatus warming up sufficiently when printing is performed continuously for an extended period of time. At this time, harmonic levels of a specific order increase despite control being performed so as to avoid using heater current application start timings at which harmonic levels will be adversely affected, due to repeatedly using the same current application start timings. Thus, each of the distribution patterns desirably has as large an amount of distribution as possible. Specifically, there are desirably three or more power duty ratios (second power duty ratios D) per one half wave of AC power, in a single cycle of AC power supplied from a commercial power supply. An increase in harmonic levels of specific order can thereby be prevented, even in the case where power input to the heater stabilizes to a substantially constant value, as a result of providing a plurality of timings as heater current application start timings.

Here, the engine controller 126 also functions as a selection portion that selects a numerical sequence for adjustment corresponding to the first power duty ratio P from the four patterns of numerical sequences for adjustment stored in the engine controller 126 serving as a storage portion. For example, in the case where the required power duty ratio P calculated by the engine controller 126 is judged to be larger than P5 (here, 37%) and less than or equal to P6 (here, 62%) (S1004), the power duty ratios D are determined based on the required power duty ratio P and the distribution pattern 3 of FIG. 7 (S1005).

Figure 8:
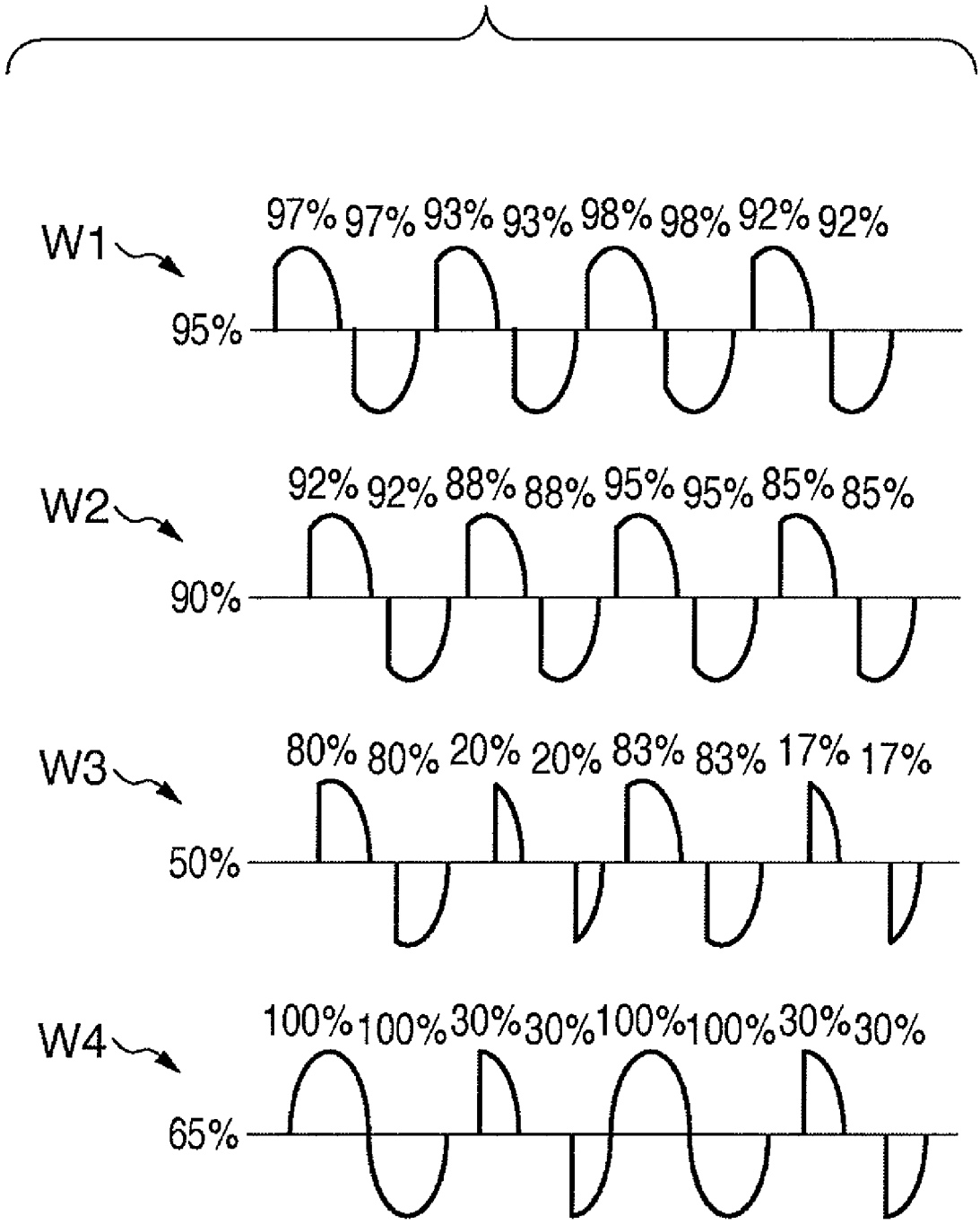
FIG. 8 shows current waveforms according to the First Embodiment of the present invention.

W3 in FIG. 8 shows a current waveform supplied to the ceramic surface heater 109*c* using the distribution pattern 3 when P is calculated to be 50%. Here, a sudden variation in power in a short period of time arises when the triac 204 is driven at timings (phases) corresponding to power between P5 and P6, and harmonic noise increases. Thus, the distribution pattern 3 is used to adjust the temperature of the ceramic surface heater 109*c* with power that does not increase harmonic noise. The power duty ratio at the lower limit of the phase control prohibition range is 38%, and the power duty ratio at the upper limit of the phase control prohibition range is 62%. The engine controller 126, serving as a second determination portion, determines the second power duty ratios D such that the start and end timings of the power supply to the ceramic surface heater 109*c* within one full wave avoid a range of ten degrees before and after a predetermined prohibited phase range (90 degree phase angle (=50% duty ratio)), or in other words, a duty ratio of 38% to 62%. Note that the distribution patterns are determined so as to be bilaterally symmetrical in order to satisfy symmetrical control.

Next, in the case where, at S1004, P is not judged to be larger than P5 (37%) and less than or equal to P6 (62%), it is judged whether P is larger than P4 (32%) and less than or equal to P5 (37%), or larger than P6 (62%) and less than or equal to P7 (67%) (S1006). In the case where, at S1006, P is judged to be larger than P4 (32%) and less than or equal to P5 (37%), or larger than P6 (62%) and less than or equal to P7 (67%), the input power duty ratios D are determined based on the required power duty ratio P and the determination pattern 4 in FIG. 7 (S1007). Desired power can be supplied to the ceramic surface heater 109*c* without driving the triac 204 at timings corresponding to power between duty ratios of 38% to 62% by using the distribution pattern 4. W4 in FIG. 8 shows a current waveform supplied to the ceramic surface heater 109*c* using the distribution pattern 4, when P is calculated to be 65%.

In the case where, at S1006, P is not judged to be larger than P4 (32%) and less than or equal to P5 (37%), or larger than P6 (62%) and less than or equal to P7 (67%), it is judged whether P is larger than P2 (9%) and less than or equal to P3 (20%), or larger than P8 (79%) and less than or equal to P9 (90%) (S1008). In the case where, at S1008, P is judged to be larger than P2 (9%) and less than or equal to P3 (20%), or larger than P8 (79%) and less than or equal to P9 (90%), the input power duty ratios D are determined based on the required power duty ratio P and the determination pattern 2 in FIG. 7 (S1009). W2 in FIG. 8 shows a current waveform supplied to the ceramic surface heater 109*c* using the distribution pattern 2, when P is calculated to be 90%.

In the case where, at S1008, P is not judged to be larger than P2 (9%) and less than or equal to P3 (20%), or larger than P8 (79%) and less than or equal to P9 (90%), it is judged whether P is larger than 0% and less than or equal to P1 (4%), or larger than P10 (95%) and less than or equal to 100% (S1010). In the case where, at S1010, P is judged to be larger than 0% and less than or equal to P1 (4%), or larger than P10 (95%) and less than or equal to 100%, the input power duty ratio D is made the same as the required power duty ratio P, and distribution control is not performed (S1011).

In the case where, at S1010, P is not judged to be larger than 0% and less than or equal to P1 (4%), or larger than P10 (95%) and less than or equal to 100%, the input power duty ratios D are determined based on the required power duty ratio P and the distribution pattern 1 in FIG. 7 (S1012). W1 in FIG. 8 shows a current waveform supplied to the ceramic surface heater 109*c* using the distribution pattern 1, when P is calculated to be 95%. P1 to P10 are appropriately set depending on specifications such as secondary load on the laser printer and the resistance values of the ceramic heater.

The drive start timings t of the triac 204 are calculated for four full waves, based on the application power duty ratios D thus determined (S1013). The calculation of t is performed using a table such as table 2. Table 2 is a table in the case where the frequency of the commercial power supply is 50 Hz. To address variations in the frequency of the commercial power supply, the frequency of the commercial power supply may be measured, and t may be calculated in accordance with the measurement result.

TABLE 2

| P [%] | t [msec] |
|---|---|
| 100 | 0.00 |
| 99 | 1.16 |
| . | . |
| . | . |
| . | . |
| 75 | 3.68 |
| . | . |
| . | . |
| . | . |
| 50 | 5.00 |
| . | . |
| . | . |
| . | . |
| 25 | 6.32 |
| . | . |
| . | . |
| . | . |
| 1 | 8.84 |
| 0 | 10.00 |

The triac 204 is driven for four full waves, based on t calculated at S1013 (S1014). Next, it is judged whether a heater ON request has occurred (S1015). If a heater ON request has occurred at S1015, the processing returns to the process of S1002, and the above control is repeated. If a heater ON request has not occurred at S1015, and application of current to the heater is turned OFF (S1016) and control is ended.

Performing control such as is described above, avoids the application of current to the heater being started at timings that will cause a sudden variation in power in a short period of time. Also, an increase in harmonic levels of a specific order can be prevented, even in the case where the application of power to the heater stabilizes to a substantially constant value after the fixing apparatus has sufficiently warmed up as a result of printing being performed continuously for an extended period of time, since a plurality of current application start timings are used.

Second Embodiment

Next, a heating apparatus according to a Second Embodiment of the present invention and control in the case where this heating apparatus is applied to an image forming apparatus will be described.

Whereas, in the First Embodiment, four full waves of a commercial power supply were set as a single cycle, in the Second Embodiment, the timings at which current application to the heater is started within a single cycle when power is input are differentiated with eight full waves as a single cycle, with the aim of reducing harmonic and flicker levels. Since a larger number of current application start timings can be used than when four full waves are set as a single cycle as in the First Embodiment, an increase in harmonics of specific order can be prevented. Note that while the present embodiment will be described with eight full waves as a single cycle, the present invention is not limited to eight full waves. Here, updating of the power for supply to the heater could be delayed when a single cycle is too long, increasing the temperature variation of the heater. For this reason, the length of a single heater control cycle needs to be set with consideration for heater temperature variation, harmonic levels and flicker levels.

Figure 10:
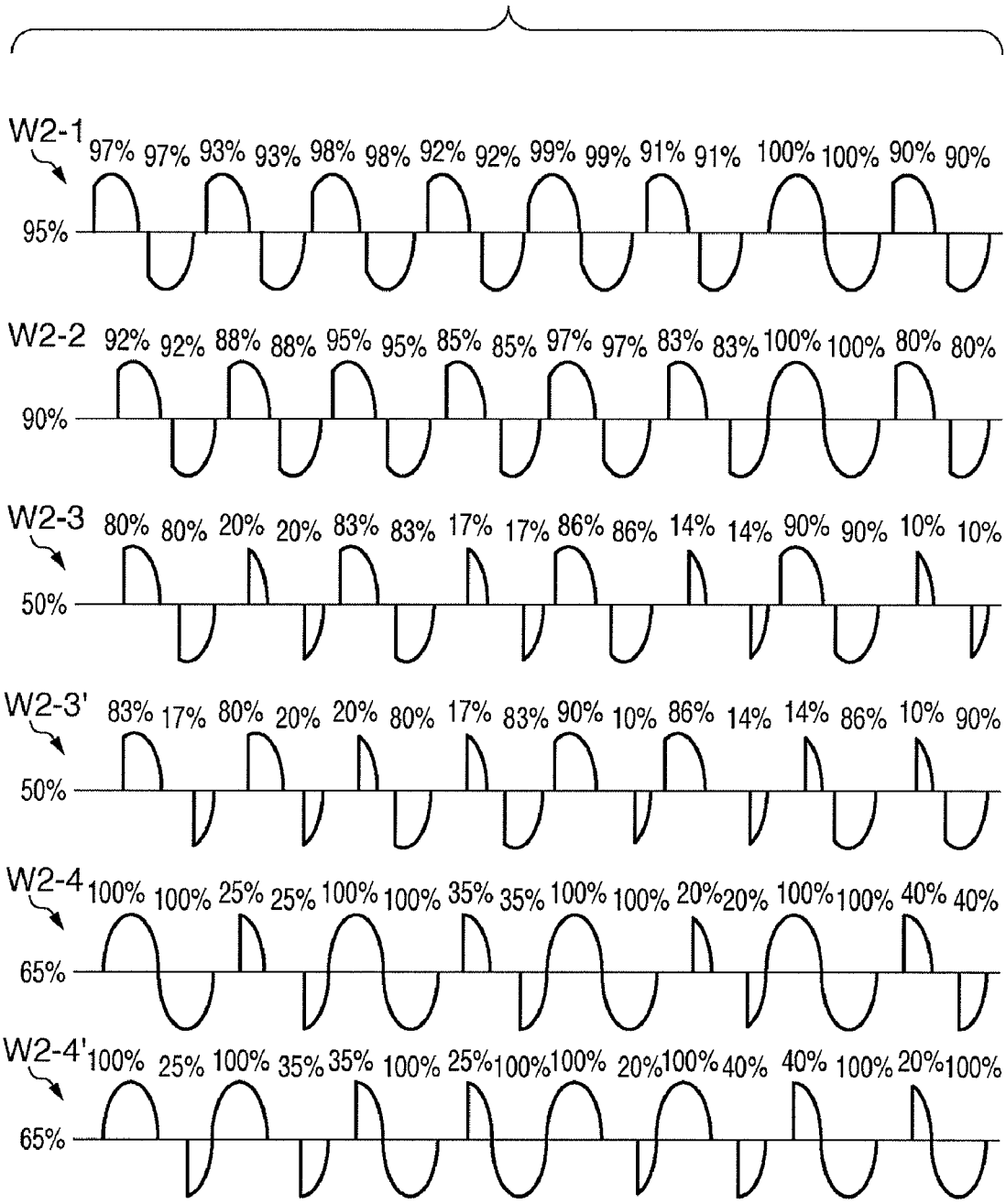
FIG. 10 shows current waveforms according to the Second Embodiment of the present invention.

FIG. 9 shows distribution patterns 2-1, 2-2, 2-3, 2-3', 2-4 and 2-4' when a single cycle is set to eight full waves, and FIG. 10 shows current waveforms W2-1, W2-2, W2-3, W2-3', W2-4 and W2-4' in the case where the distribution patterns in FIG. 9 are respectively used. There are eight timings for starting current application to the heater in a single cycle as shown in FIG. 10. Thus, the harmonics of orders corresponding to the plurality of heater current application timings respectively increase. The distribution patterns are set such that the harmonics of the respective orders increase to a lesser extent than the significant increase in harmonic levels of specific order that occurs when specific heater current application timings are repeatedly used.

However, the pattern of input power to the heater approximates the input power pattern of wave number control as a result of using given distribution patterns. For example, at W2-4 in FIG. 10, input power to the heater is "100%, 100%, 25%, 25%, 100%, 100%, 35%, 35%, 100%, 100%, 20%, 20%, 100%, 100%, 40%, 40%" in units of one half waves. In this case, flicker levels could increase, since there is a large variation in power. In view of this, in the present embodiment, the order in which power is input in a single cycle is changed in order to suppress any increase in flicker levels. Flicker levels also vary depending on the power variation cycle. Thus, the power variation cycle can be changed by changing the order of power supply in a single cycle, enabling flicker levels to be improved. Flicker levels are improved the shorter the power variation cycle. Thus, in the case where the power duty ratios of input power to the heater per one half wave include a power duty ratio Dhigh that is larger than a predetermined first value (e.g., 80%) and a power duty ratio Dlow that is smaller than a predetermined second value (e.g., 40%), control is performed such that the number of consecutive one half waves having Dhigh in a single cycle is minimized. Note that the distribution patterns are set so as to satisfy symmetrical control in a single cycle.

2-4' in FIG. 9 shows a distribution pattern for improving flicker levels and W2-4' in FIG. 10 shows the heater current waveform at this time. With W2-4 in FIG. 10, current is applied to the heater consecutively for two half waves at a small power duty ratio of 40% or less after applying current to the heater consecutively for two half waves at a power duty ratio of 100%. In this case, the power variation cycle will be 25 Hz, since a variation occurs in four half wave cycles. In contrast, heater current is alternately applied a 100% power duty ratio and a small power duty ratio every one half wave, as shown by W2-4' in FIG. 10, as a result of using the distribution pattern 2-4' in FIG. 9. At this time, the power variation cycle will be 50 Hz, enabling flicker levels to be improved by shortening the power variation cycle. The distribution pattern in 2-3' in FIG. 9 and W2-3' in FIG. 10 is set similarly to 2-4' in FIG. 9 and W2-4' in FIG. 10. Increases in harmonic levels and flicker levels can be suppressed by performing the above control.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-147001, filed Jun. 19, 2009, which is hereby incorporated by reference herein in its entirety.

What is claimed is:

1. A fixing apparatus comprising:

a power supply unit that supplies AC power from a commercial power supply to a heater;

a temperature detection element that detects a temperature of the heater;

a setting unit that sets a required power duty ratio P for providing power to the heater such that the temperature detected by the temperature detection element maintains a target temperature; and a control unit that controls the power supply unit such that an average power duty ratio of input power duty ratios D for full waves of the AC power to be supplied to the heater during a single control cycle equals the required power duty ratio P, set based on the detected temperature, wherein the single control cycle includes at least first to fourth full waves of the AC power, the first full wave having a first input power duty ratio D, equal to a power duty ratio obtained by adding a first predetermined value to the required power duty ratio P, the second full wave having a second input power duty ratio D, equal to a power duty ratio obtained by subtracting the first predetermined value from the required power duty ratio P, the third full wave having a third input power duty ratio D, equal to a power duty ratio obtained by adding a second predetermined value to the required power duty ratio P, and the fourth full wave having a fourth input power duty ratio D, equal to a power duty ratio obtained by subtracting the second predetermined value from the required power duty ratio P.

2. The fixing apparatus according to claim 1, further comprising:

a cylindrical fixing film having an inside surface contacting the heater; and a pressure roller which forms, together with the heater via the cylindrical fixing film, a fixing nip portion through which passes a recording sheet with an unfixed image.

* * * * *